US009903579B2

(12) United States Patent
Janssen et al.

(10) Patent No.: US 9,903,579 B2
(45) Date of Patent: Feb. 27, 2018

(54) LED LIGHTING DEVICE

(75) Inventors: Robert Hendrik Catharina Janssen, Beek (NL); Hans Klaas Van Dijk, Sittard (NL)

(73) Assignee: DSM IP ASSETS B.V., Heerlen (NL)

( * ) Notice: Subject to any disclaimer, the term of this patent is extended or adjusted under 35 U.S.C. 154(b) by 1283 days.

(21) Appl. No.: 13/575,465

(22) PCT Filed: Feb. 9, 2011

(86) PCT No.: PCT/EP2011/051850
§ 371 (c)(1),
(2), (4) Date: Oct. 16, 2012

(87) PCT Pub. No.: WO2011/098463
PCT Pub. Date: Aug. 18, 2011

(65) Prior Publication Data

US 2013/0051011 A1 Feb. 28, 2013

(30) Foreign Application Priority Data

Feb. 11, 2010 (EP) ..... 10153302

(51) Int. Cl.
*F21V 29/70* (2015.01)
*F21K 9/90* (2016.01)
(Continued)

(52) U.S. Cl.
CPC ..... *F21V 29/70* (2015.01); *F21K 9/90* (2013.01); *F21V 15/01* (2013.01); *F21V 29/004* (2013.01); *F21Y 2115/10* (2016.08)

(58) Field of Classification Search
CPC ..... F21K 9/13; F21K 9/00; F21K 9/90; F21V 29/22; F21V 13/04; F21V 7/00;
(Continued)

(56) References Cited

U.S. PATENT DOCUMENTS

2010/0163890 A1* 7/2010 Miskin ..... 257/88
2011/0095690 A1* 4/2011 Sagal ..... B29C 45/14 315/113
2011/0279035 A1 11/2011 Van Dijk et al.

FOREIGN PATENT DOCUMENTS

EP 1 691 130 8/2006
KR 1020090063251 6/2009
(Continued)

OTHER PUBLICATIONS

International Search Report for PCT/EP2011/051850, dated Mar. 21, 2011.

*Primary Examiner* — Bao Q Truong
(74) *Attorney, Agent, or Firm* — Nixon & Vanderhye P.C.

(57) ABSTRACT

The invention relates to a LED lighting device LLD) comprising a heat spreader, having a front side and a back side; LEDs mounted on a PCB positioned on the front side of the heat spreader; a reflector or lens covering the LEDs; a socket for being received by an electrical supply system; optionally a base part; electronic driver components mounted on the back side of the heat spreader or inside the socket or base part; electrical leads or wiring system connecting the socket, the electronic driver components and the heat spreader; and a housing, optionally encapsulating the electronic components and the electrical leads or wiring system, being in thermally conductive contact with the heat spreader, wherein the housing is made of an thermally conductive, electrically conductive plastic material (TC/EC-material-A), covered with a protection layer consisting of an electrically insulating material (EI-material-B), on the outside of the housing.

15 Claims, 1 Drawing Sheet

(51) Int. Cl.
*F21V 15/01* (2006.01)
*F21V 29/00* (2015.01)
*F21Y 115/10* (2016.01)

(58) Field of Classification Search
CPC . F21V 5/04; F21V 29/70; F21V 15/01; F21V 29/004; F21V 29/85; F21V 29/89; F21V 29/503; F21S 48/328; F21Y 2115/10; H01L 33/64
USPC ..... 362/235, 249.02, 294, 296.01, 311.01, 362/311.02, 373, 800
See application file for complete search history.

(56) References Cited

FOREIGN PATENT DOCUMENTS

| | | |
|---|---|---|
| WO | WO 2004/036114 | 4/2004 |
| WO | WO 2006/094346 | 9/2006 |

* cited by examiner

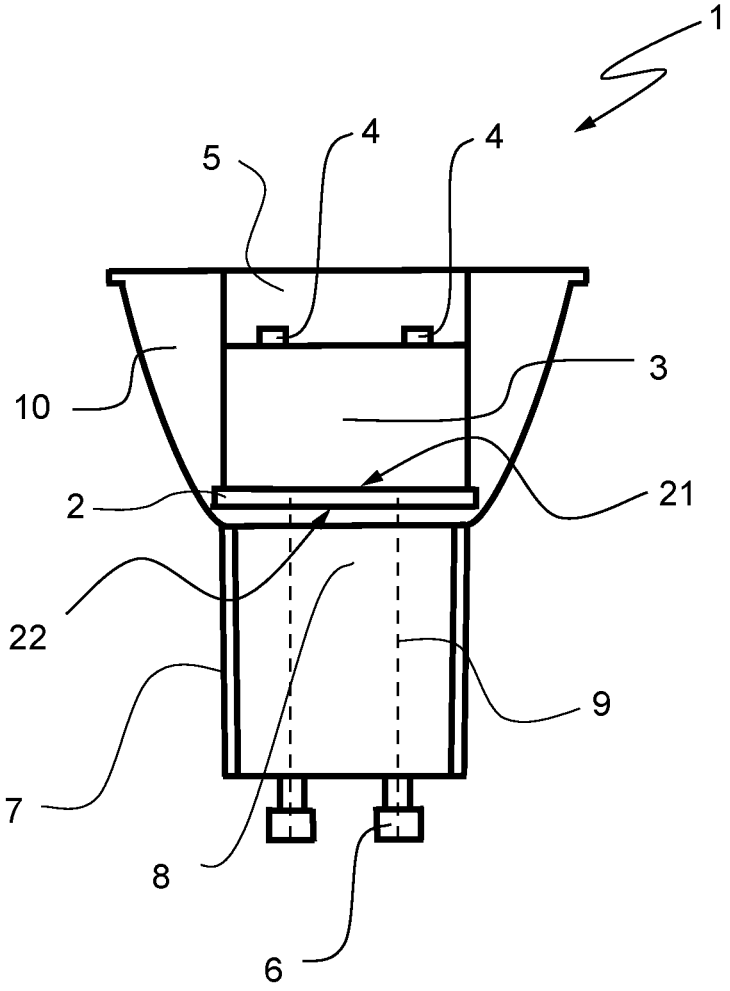
1
5
4
4
10
3
2
21
22
9
7
8
6

LED LIGHTING DEVICE

This application is the U.S. national phase of International Application No. PCT/EP2011/051850 filed 9 Feb. 2011 which designated the U.S. and claims priority to EP Patent Application No. 10153302.4 filed Feb. 11, 2010, the entire contents of each of which are hereby incorporated by reference.

FIELD

The invention relates to a LED lighting device, more particular a LED lighting device (LLD) comprising a heat spreader, LEDs, a reflector or lens, a socket, electronic driver components, electrical leads or wiring system and a housing.

BACKGROUND AND SUMMARY

Light emitting diodes, know as LED or LED lamps, are used as light source in solid state lighting (SSL). LED lighting or lamps are generally classified based on the shape of reflector (MR, PAR, R, A) and socket base (GU, E, bayonet). SSLs usually comprise clusters of LEDs in a suitable housing with an electronic driver and optics including the reflector. Lamps deliver light output, generally expressed in lumens, while consuming power, expressed in watts. The efficiency or in fact the light efficiency of lamps can be expressed in lumens/watt. The inefficiency results primarily from the fact that LEDs and the electronic driver produce heat.

A problem with LED lighting is that the light produced by LEDs and the life time of LEDs is negatively influenced by the heat produced by the LED junctions and electronics in the LED lighting device. LEDs need to be cooled down as heat has a negative influence on the light output as well as the lifetime of the lamp. The life time of an LED herein is not so much to the moment in time that the LED breaks down or starts to malfunction, but the speed at which the efficiency of the LED during the functional use diminishes. The life time can be expressed for example as the functional use time after which the efficiency has reduced to below 70% of the original efficiency. This problem of heat generation and overheating is generally combated by using heat spreaders and housings of thermally conductive materials, in particular metal. Metals offer suitable thermal management solutions, but have significant drawbacks in the field of design, manufacturing and isolation for safety. For that reason, LED lamp producers started to consider replacing metal. Ceramics have been considered but use thereof is still limited, since ceramic appeared to be too brittle in several cases. Plastics, in particular thermally conductive grades, are introduced where the housing part of the LED lamps is concerned. For example in EP-1691130-A1 and WO-2006/094346-A1, LED lighting devices are described, which devices comprise a heat spreader, LEDs mounted on a PCB, a reflector, a socket and a housing. The housing is made of thermally conductive plastic material. These plastics are either too limited in their thermal conductivity, or in case plastic materials with a high thermal conductivity are used, these provide the same problems as with observed metals.

However, for general industry and consumer applications the safety requirements are steadily increasing. In particular with components made of metal and highly conductive materials introducing the risk of electrical short circuitry safety is an issue. For that reason, producers of LED lighting devices use safe electronics with insulated driver systems.

Insulated driver systems however, require higher energy input for the same amount of light produced, thus not only resulting in much lower driver efficiency, but also higher heat production. The heating effect also limits the maximum power of LED lamps, which nowadays is about 11 W. Alternatively, the LED lighting device comprises an internal insulating shield, protecting the electronic components from contacting the outer parts. Such protection however also complicates or corroborates dissipation of heat produced by the electronics. Thus there is a need for a LED lighting device that is energy efficient, can be used with unsafe (i.e. non-insulated) electronic driver systems, and nevertheless complies with safety regulations and preferably can be designed as high power lamp.

The aim of the present invention is to provide a LED lighting device that is economic and efficient in light production and/or allow for a long life time of the LED light, is easy to produce and also safe. Moreover, since such lamps are becoming used more and more in the consumer area, the LED lighting devices preferably should be simple in its production and assembly, allowing for mass production.

This aim has been achieved by the LED lighting device (LLD) according to the invention wherein the LLD comprises:

- a heat spreader, having a front side and a back side,
- LEDs mounted on a PCB positioned on the front side of the heat spreader,
- a reflector or lens, covering the LEDs,
- a socket for being received by an electrical supply system, optionally a base part,
- electronic driver components mounted on the back side of the heat spreader or inside the socket or base part,
- electrical leads or wiring system connecting the socket, the electronic driver components and the heat spreader,
- and a housing, optionally encapsulating the electronic components and the electrical leads or wiring system, being in thermally conductive contact with the heat spreader,
- wherein the housing is made of a thermally conductive, electrically conductive plastic material (TC/EC-material-A), covered with a protection layer consisting of an electrically insulating material (El-material-B) on the outside of the housing.

BRIEF DESCRIPTION OF THE DRAWINGS

FIG. 1 is a schematic cross-sectional view of an exemplary LED lighting device (LLD) in accordance with an embodiment of the invention.

DETAILED DESCRIPTION

Accompanying FIG. 1 schematically depicts an exemplary LED lighting device (LLD) 1 which embodies the present invention. As shown, the LLD 1 includes a heat spreader 2 having front and back sides (21, 22, respectively) and a printed circuit board (PCB) 3 positioned on the front side 21 of the heat spreader 2. Light emitting diodes (LEDs) 4 are mounted on the PCB 3 with a reflector or lens 5 covering the LEDs 4. A socket 6 is provided with a base part 7 to receive an electrical supply system (not shown). Electronic driver components 8 are mounted on the back side 22 of the heat spreader 2 or alternatively may be mounted inside the socket 6 or base part 7. A housing 10 is provided in thermal conductive contact with the heat spreader 2.

The effect of the LLD 1 which embodies the present invention is that the LED lighting device shows very good heat dissipation, while the presence of the electrically insulting protection layer has hardly any effect on the heat management and the light efficiency of the lamp, even if the protection layer is made of an electrically insulting and thermally non-conductive material. Meanwhile the safety of the LLD is increased. This means that the LED lighting device 1 according to the invention can be used in combination with a non-insulated or non-safe driver system working at 110 or 220 Volts, while still providing a safe construction without the need of an internal shield. Likewise the electronic components in the LLD according to the invention are "non-safe" electronic components. The new and inventive LLD may also be used in combination with insulated driver systems thus providing increased safety. The solution according to the invention is also much more effective in terms of heat management than alternative solutions, such as an electrical barrier layer between the housing and the heat spreader, or an isolating layer in the inside of the housing. Moreover, the housing provided with the electrically insulting protection layer on the outside of the housing can be produced by simple production processes, such as electrostatic painting of a powder coating, while this would be much more complicated for an inside layer.

Painting of metal with a powder coating by electrostatic painting is known in the art. Such painting generally serves to provide a color or to protect the metal from rusting. Painting of electrically conductive polymers with a powder coating by electrostatic painting as such is also known in the art. Conductive polymers have found use in applications ranging from automotive parts to electronic appliances, building and construction. In these applications painting is typically used to enable to provide the plastic part with the look and appearance of a metallic part. The coating may also be applied to improve the surface quality. For example, WO-2004/036114-A1 describes a reflector for a headlamp. The reflector of WO-2004/036114-A1 is made from the thermally conductive material, which is purposively made electrically conductive, such that the reflector can be lacquered using techniques of electrostatic powder deposition. Afterwards, the lacquered reflectors were coated with a thin reflecting layer.

The lens 5 in the LLD 1 is generally made of a transparent or translucent material, for example glass or a transparent plastic. The lens may also consist of such a transparent cover comprising multiple lenses, for example one lens for each individual LED.

As noted above, the LLD 1 may comprise a base part 7. The base part 7 is considered the part between the socket 6 and the housing 10. As such the base part 7 can be considered as an extension of the housing 10. In case the LLD 1 does not comprise a separate base part 7, the housing 10 might comprise an integrated extension performing the same function as the base part 7.

The thermally conductive, electrically conductive plastic material from which the housing 10 is made will herein further be denoted as TC/EC-material-A. The material that is used for TC/EC-material-A may be any plastic material that is both thermally conductive and electrically conductive. These formulations typically contain a polymer and generally relative high amount of thermally conductive fillers which are also electrically conductive. Examples of such fillers include metal and graphite.

The TC/EC-material-A used in the present invention may have a thermally conductivity varying over a wide range.

Suitably, TC/EC-material-A has a through-plane thermally conductivity of at least 1 W/mK, more preferably, at least 1.5 W/m/K and most preferably at least 2 W/mK. Though there is no real maximum to the through-plane thermally conductivity, in general it will be at most 6 W/mK. Also suitably, TC/EC-material-A has a parallel in-plane thermally conductivity of at least 2.5 W/mK, more preferably, at least 5 W/m/K and most preferably at least 10 W/mK. Though there is no real maximum for the through-plane thermally conductivity, in general it will be at most 20 W/mK. Since the electrical conductivity of the thermally conductive material will generally increase it has an advantage to limit the thermal conductivity. Preferably, TC/EC-material-A has a through-plane thermally conductivity in the range of 1.5-4 W/mK, and/or a parallel in-plane thermally conductivity in the range of 5-15 W/mK.

The thermal conductivity mentioned herein is measured with the method described further below. It is noted that the material properties mentioned herein are all measured at room temperature, i.e. at 20° C.

TC/EC-material-A may also have an electrically conductivity varying over a wide range. Suitably, TC/EC-material-A has a volume resistivity, measured by the method according ISO69003 on samples in through plane direction, of at most $10^6$ Ohm. Such a volume resistivity is not high enough for safe use in a housing with non-safe electronics without the use of an electrically insulating protection layer. However, the volume resistivity is sufficiently low to provide the housing with such an electrically insulating protection layer by means of an electrostatic spraying process with powder coating. Though within the scope of the present invention there is no real need to put a minimum to the volume resistivity of TC/EC-material-A, in general it is preferred for safety reasons that the electrical conductivity of that material is limited. In that respect, TC/EC-material-A suitably has a volume resistivity of at least $10^{-2}$ Ohm, and preferably at least 1 Ohm. More preferably, the volume resistivity is in the range of $10^1$-$10^5$ Ohm.

TC/EC-material-A, suitably has a heat distortion temperature (as measured by ISO 75) (HDT-A), of at least 160° C., preferably at least 180° C., and more preferably at least 200° C. Powder coatings, after being applied by electrostatic painting, are typically cured under heat to allow it to flow and form a film. A higher HDT is advantageous for a better curing process thereby obtaining a better adhesion between the electrically insulating protection layer and TC/EC-material-A of which the basic part of the housing is made.

The electrically insulating protection layer may have a thickness varying over a quite a broad range, which range can be effected by the thermal conductive properties of the El-material-B, and the heat performance requirements of the LLD. The thickness should of course not be too large to prevent heat dissipation by the housing, and neither should be too small to prevent sufficient protection. The thickness of the protection layer suitably is in the range of 25-250 μm, although depending on how good the electrical insulation properties of the layer are the thickness might even be lower than the lower limit, or respectively higher than the upper limit depending on how good the thermal conductivity properties of the layer are. Preferably the thickness is in the range of 50-150 μm.

The electrically insulating material from which the protection layer is made, which material will be herein abbreviated as El-material-B, may have a dielectric strength varying over a large range, wherein it is clear that the higher the dielectric strength is, the better the electrically insulating properties of the protection layer or otherwise the thinner the protection layer can be. Suitably, the dielectric strength (measured according ASTM D 149) of El-material-B is at least 1 kV/mm. The dielectric strength is preferably at least 5 kV/mm and still more preferably at least 10 kV/mm.

For the electrically insulating protection layer any material may be used that can be processed as a powder coating and has such dielectric properties. The said material can be a thermoset material as well as a thermoplastic material. Alternatively, for the protection layer an electrically insulating moulding composition is used. For this purpose, typically a thermoplastic material is used. The said material may comprise, next to a thermosetting and/or a thermoplastic polymeric material, other components, such as fillers, pigments, stabilizers and other auxiliary additives used in powder coatings, as well as flame retardants and thermally conductive fillers, provided the component or components used in the material have a high dielectric strength. The person skilled in the art can select components that can suitably be used in the El-material-B, using common general knowledge.

El-material-B may be a thermally conductive, electrically isolating material, comprising thermally conductive fillers. Such a material might well have a through-plane thermal conductivity in the range of 0.5-1.5 W/mK, preferably 0.5-1.0 W/mK.

Alternatively, the El-material-B may be a thermally isolating material. The latter appears not to influence, at least not in a significant extent, the heat management properties of the LLD according to the present invention. An advantage of the El-material-B being a thermally isolating material is that generally the safety performance of the LLD is further enhanced. Suitably, the El-material-B has a through-plane thermal conductivity of less than 0.5 W/mK.

The El-material-B preferably comprises a flame retardant. The advantage is that the safety performance of the LLD in terms of flammability is better retained or even further enhanced.

To create a good thermally conductive contact between the housing and the heat spreader, the housing is suitably produced by overmoulding one or more metal parts with a moulding material, thereby shaping the housing. The metal part or parts can be either the heat spreader, or metal elements which are mounted in the assembled in the LLD on the heat spreader. By such overmoulding the best thermally conductive contact can be achieved between the housing and the metal part or parts, while thermally conductive between different metal in direct contact with each other is typically good.

In one preferred embodiment of the LLD according to the invention, the protection layer is a coating layer. Preferably, the coating is a powder coating applied by electrostatic spraying. The use of a thermally conductive, electrically conductive plastic material with a sufficiently high heat deformation temperature (HDT) not only allows for application of such electrostatically sprayed coating but also curing of the powder coating. Preferably, the HDT of the thermally conductive, electrically conductive plastic material is at least 160° C., more preferably at least 180° C., still more preferably at least 200° C.

In another preferred embodiment of the LLD according to the invention the housing is produced in a 2K moulding process, wherein a first moulding is made of the EC/TC-material-A, which is than overmoulded with a layer of the El-material-B The invention also relates to a process for making a housing for an LLD. The process according to the invention comprises the steps of a. Providing a mould with a cavity for shaping the housing;
b. Injection moulding a thermally conductive and electrically conductive plastic material into the cavity, thus forming a moulded part;
c. Taking the thus formed molded part from the cavity;
d. Applying a powder coating on the outside surface of the housing by electrostatic spraying;
e. Curing the optionally applied powder coating.

An alternative process for making the housing for the LLD according to the invention comprises the steps of a. Providing a mould with a cavity for shaping the housing;
b. (i) Injection moulding a thermally conductive and electrically conductive plastic material into the cavity, thus forming a moulded part;
   (ii) Injection moulding an electrically insulating plastic material into the cavity, thereby forming an electrically insulating layer on the outside surface of the moulded part;
c. Taking the thus formed molded part with the electrically insulating layer from the cavity.

In a preferred embodiment thereof, the process comprises a step (a-1) after step (a) and before step (b), wherein one or more metal parts are positioned in the cavity, which metal part or parts are partially overmoulded with the electrically conductive plastic material (TC/EC material) during step (b) respectively (b)(i).

The housing produced by overmoulding the metal heat spreader or other metal parts with the thermally conductive plastic material, can be coated with a coating layer as before. Optionally also the metal heat spreader or parts thereof can simultaneously be coated with an electrically isolating coating layer. The heat spreader or parts thereof which should not to be coated, when necessary can be shielded during the coating process.

The invention is further illustrated with the following examples and comparative experiments.

Illustration with Examples and Comparative Experiments

Method

For this illustration a convention LED lighting device with a metal heat spreader and a metal housing was used, wherein the metal housing was replaced by a similar housing made of a graphite filled thermally conductive and electrically conductive plastic material with a volume resistivity of about $10^2$ Ohm, an in-plane thermal conductivity of about 15 W/mK and a through-plane thermal conductivity of about 15 W/mK of about 1.75 W·mK.

Thermal Conductivity

Through plane thermal conductivity measurements were made suing a laser flash and probe method. A Nettzsch™ Nanoflash Instrument was used to conduct the laser flash testing according to ASTM standard E1461. Test specimens dimensions for the laser flash were 2 mm thick×12.5 mm diameter. Thermal conductivity was measured using an Elmer Pyris thermal conductivity probe, and is reported in Watts per meter-Kelvin (W/mK). All measurements were conducted at room temperature (20° C.) on injection moulded plaques.

Example I

The plastic housing was provided with a coating layer with a thickness of 100 μm, made of a transparent thermally isolating material (λ-coating=0.2 W/mK). The effect on the temperature of the electronic components inside the lighting device was a temperature rise of about 1° C.

Example II

Example I was repeated except that a plastic housing provided with a filled coating layer exhibiting thermally conductivity (A-coating=1.0 W/mK) was used. The effect on the temperature of the electronic components inside the lighting device dropped to a temperature rise of only 0.2° C.

Example III

A test sample was prepared from the material used in Example. First, the graphite filled thermally conductive and electrically conductive plastic material was injection moulded into plates of 80×80 mm and thickness 2 mm. After demoulding and cooling, the transparent thermally isolating material was applied to provide a coating layer with a thickness of about 100 μm. The test plates appeared to have a break-through voltage of over 10 kV.

Comparative Example A

The heat spreader was provided with a coating layer with a thickness of 100 μm, made of the transparent thermally isolating material (A-coating=0.2 W/mK) at the positions of contact between the heat spreader and the housing. The effect on the temperature of the electronic components inside the lighting device was a temperature rise of about 10° C.

Comparative Example B

Comparative Example A was repeated except that a heat spreader provided with the thermally conductive coating layer as in Example II (A-coating=1.0 W/mK) was used. The effect on the temperature of the electronic components inside the lighting device dropped to a temperature rise of about 2° C.

Surprisingly, the use of an isolating coating layer has only a limited effect on the on the heat management of the light device. The effect of the coating on the housing is far less than the use of a similar isolating layer between the heat spreader and the housing. Moreover, the layer on the housing also provides for a better protection than the isolating layer on the heat spreader against electrical breakdown, in particular if such breakdown would occur directly from the electrical components through the housing.

The invention claimed is:

1. A light emitting diode lighting device (LLD) comprising:

a heat spreader having a front side and a back side, a printed circuit board (PCB) positioned on the front side of the heat spreader, light emitting diodes (LEDs) mounted on the PCB, a reflector or lens covering the LEDs, a socket for receiving an electrical supply system, optionally a base part, electronic driver components mounted on the back side of the heat spreader or inside the socket or base part, electrical leads or wiring system connecting the socket, the electronic driver components and the heat spreader, and a housing, optionally encapsulating the electronic driver components and the electrical leads or wiring system, the housing being in thermally conductive contact with the heat spreader, wherein the housing is made of an thermally conductive, electrically conductive plastic material (TC/EC-material-A), covered with a protection layer consisting of an electrically insulating material (El-material-B) on an outside of the housing, and wherein the TC/EC-material-A has a through-plane thermal conductivity, measured according to ASTM standard E1461 at 20° C., in a range of 1-6 W/mK, and the El-material-B has a through-plane thermal conductivity of less than 0.5 W/mK.

2. The LLD according to claim 1, wherein the TC/EC-material-A has a volume resistivity, measured according to ISO69003, in a through plane direction, in a range of $10^{-2}$-$10^{6}$ Ohm.

3. The LLD according to claim 1, wherein the TC/EC-material-A has an heat distortion temperature (HDT-A), as measured by ISO 75, of at least 160° C.

4. The LLD according to claim 1, wherein the protection layer is a coating layer applied by an electrostatic spraying process.

5. The LLD according to claim 1, wherein the protection layer has a thickness of 25-250 μm.

6. A process for making a housing for an LLD according to claim 1, comprising the steps of:

(a.) providing a mould with a cavity for shaping the housing;

(b.) injection moulding a thermally conductive and electrically conductive plastic material into the cavity, thus forming a moulded part;

(c.) taking the thus formed molded part from the cavity;

(d.) applying a powder coating on an outside surface of the housing by electrostatic spraying; and (e.) optionally curing the applied powder coating.

7. A process for making a housing for an LLD according to claim 1, comprising the steps of:

(a.) providing a mould with a cavity for shaping the housing;

(b.) forming a molded part with an electrically insulating layer by (i) injection moulding a thermally conductive and electrically conductive plastic material into the cavity, thus forming a moulded part, and (ii) injection moulding an electrically insulating plastic material into the cavity, thereby forming an electrically insulating layer on an outside surface of the moulded part; and (c.) taking the thus formed molded part with the electrically insulating layer from the cavity.

8. The LLD according to claim 3, wherein the HDT-A of the TC/EC-material-A is at least 180° C.

9. The LLD according to claim 3, wherein the HDT-A of the TC/EC-material-A is at least 200° C.

10. A light emitting diode lighting device (LLD) comprising:

a heat spreader having a front side and a back side, a printed circuit board (PCB) positioned on the front side of the heat spreader, light emitting diodes (LEDs) mounted on the PCB, a reflector or lens covering the LEDs, a socket for receiving an electrical supply system, optionally a base part, electronic driver components mounted on the back side of the heat spreader or inside the socket or base part, electrical leads or wiring system connecting the socket, the electronic driver components and the heat spreader, and a housing, optionally encapsulating the electronic driver components and the electrical leads or wiring system, the housing being in thermally conductive contact with the heat spreader, wherein the housing is made of an thermally conductive, electrically conductive plastic material (TC/EC-material-A), covered with a protection layer consisting of an electrically insulating material (El-material-B) on an outside of the housing, and wherein the TC/EC-material-A has a volume resistivity, measured according to ISO69003, in a through plane direction, in a range of $10^{-2}$-$10^{6}$ Ohm, and the El-material-B has a through-plane thermal conductivity of less than 0.5 W/mK.

11. The LLD according to claim 10, wherein the TC/EC-material-A has an heat distortion temperature (HDT-A), as measured by ISO 75, of at least 200° C.

12. A light emitting diode lighting device (LLD) comprising:

a heat spreader having a front side and a back side, a printed circuit board (PCB) positioned on the front side of the heat spreader, light emitting diodes (LEDs) mounted on the PCB, a reflector or lens covering the LEDs, a socket for receiving an electrical supply system, optionally a base part, electronic driver components mounted on the back side of the heat spreader or inside the socket or base part, electrical leads or wiring system connecting the socket, the electronic driver components and the heat spreader, and a housing, optionally encapsulating the electronic driver components and the electrical leads or wiring system, the housing being in thermally conductive contact with the heat spreader, wherein the housing is made of an thermally conductive, electrically conductive plastic material (TC/EC-material-A), covered with a protection layer consisting of an electrically insulating material (El-material-B) on an outside of the housing, and wherein the TC/EC-material-A has an heat distortion temperature (HDT-A), as measured by ISO 75, of at least 180° C., and the El-material-B has a through-plane thermal conductivity of less than 0.5 W/mK.

13. The LLD according to claim 12, wherein the HDT-A of the TC/EC-material-A is at least 200° C.

14. A light emitting diode lighting device (LLD) comprising:

a heat spreader having a front side and a back side, a printed circuit board (PCB) positioned on the front side of the heat spreader, light emitting diodes (LEDs) mounted on the PCB, a reflector or lens covering the LEDs, a socket for receiving an electrical supply system, optionally a base part, electronic driver components mounted on the back side of the heat spreader or inside the socket or base part, electrical leads or wiring system connecting the socket, the electronic driver components and the heat spreader, and a housing, optionally encapsulating the electronic driver components and the electrical leads or wiring system, the housing being in thermally conductive contact with the heat spreader, wherein the housing is made of an thermally conductive, electrically conductive plastic material (TC/EC-material-A), covered with a protection layer consisting of an electrically insulating material (El-material-B) having a through-plane thermal conductivity of less than 0.5 W/mK on an outside of the housing, and wherein the protection layer is a coating layer applied by an electrostatic spraying process.

15. The LLD according to claim 14, wherein the TC/EC-material-A has an heat distortion temperature (HDT-A), as measured by ISO 75, of at least 200° C.

* * * * *